US006963050B2

(12) United States Patent
Heindtel

(10) Patent No.: US 6,963,050 B2
(45) Date of Patent: Nov. 8, 2005

(54) PAVER AND HEATING ELEMENT

(75) Inventor: Michael Heindtel, Mannheim (DE)

(73) Assignee: Joseph Voegle AG, Mannheim (DE)

( * ) Notice: Subject to any disclaimer, the term of this patent is extended or adjusted under 35 U.S.C. 154(b) by 24 days.

(21) Appl. No.: 10/734,598

(22) Filed: Dec. 12, 2003

(65) Prior Publication Data

US 2004/0144765 A1 Jul. 29, 2004

(30) Foreign Application Priority Data

Dec. 18, 2002 (DE) ..... 202 19 641 U

(51) Int. Cl.[7] ..... H05B 1/00

(52) U.S. Cl. ..... 219/213; 219/521; 219/538; 404/95

(58) Field of Search ..... 219/213, 245, 219/254, 520–521, 534–535, 538, 543, 546, 624, 243; 404/95, 71–72, 118

(56) References Cited

U.S. PATENT DOCUMENTS 2,487,839 A * 11/1949 Van Alen ..... 338/218
2,493,542 A * 1/1950 McGraw ..... 338/319
5,359,179 A * 10/1994 Desloge et al. ..... 219/535
5,417,516 A * 5/1995 Birtchet ..... 404/71
6,318,928 B1 11/2001 Swearingen

FOREIGN PATENT DOCUMENTS

| | | | | |
|---|---|---|---|---|
| DE | 460 333 A1 | | 5/1928 | |
| JP | 01211884 A | * | 8/1989 | ..... H05B/3/20 |
| JP | 01281339 A | * | 11/1989 | ..... F24D/13/02 |
| JP | 03084423 A | * | 4/1991 | ..... G01F/1/68 |
| JP | 04020721 A | * | 1/1992 | ..... F24C/7/06 |
| JP | 04031576 A | * | 2/1992 | ..... E04H/9/16 |
| JP | 05290953 A | * | 11/1993 | ..... H05B/3/10 |
| JP | 07092852 A | * | 4/1995 | ..... G03G/15/20 |

* cited by examiner

*Primary Examiner*—Robin O. Evans
*Assistant Examiner*—Vinod Patel
(74) *Attorney, Agent, or Firm*—Darby & Darby

(57) ABSTRACT

A paver having a paving screed and at least one working component which is heated by at least one electric heating element and a smoothing plate, with the heating element being secured in heat tampering condition at a heating area of the working component. The heating element is a planar heating element with at least one heating coil being a heating conductor which is wound in a spiral around a planar carrier, and the peripheral form of the carrier material and/or the winding density or the winding course of the heating conductor is adapted to produce a predetermined heating picture in the heating area.

13 Claims, 3 Drawing Sheets

FIG 2
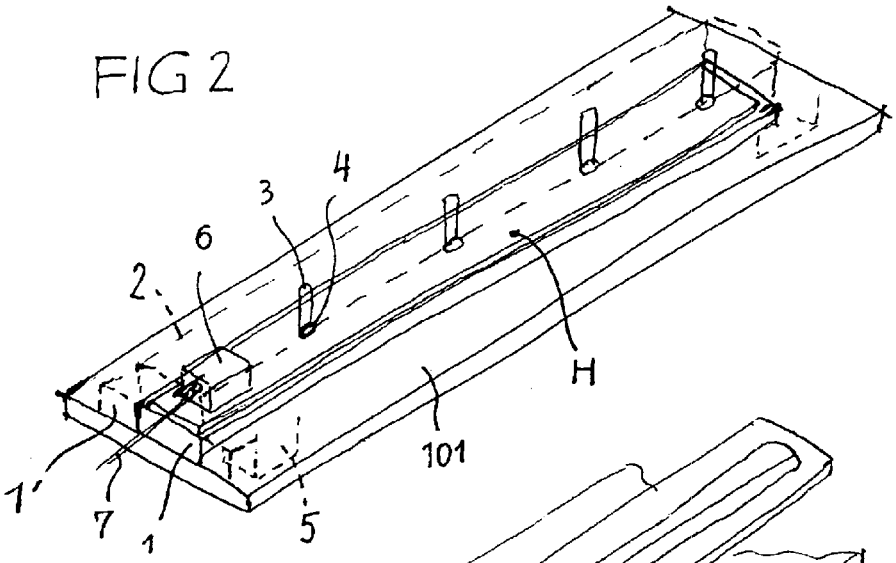
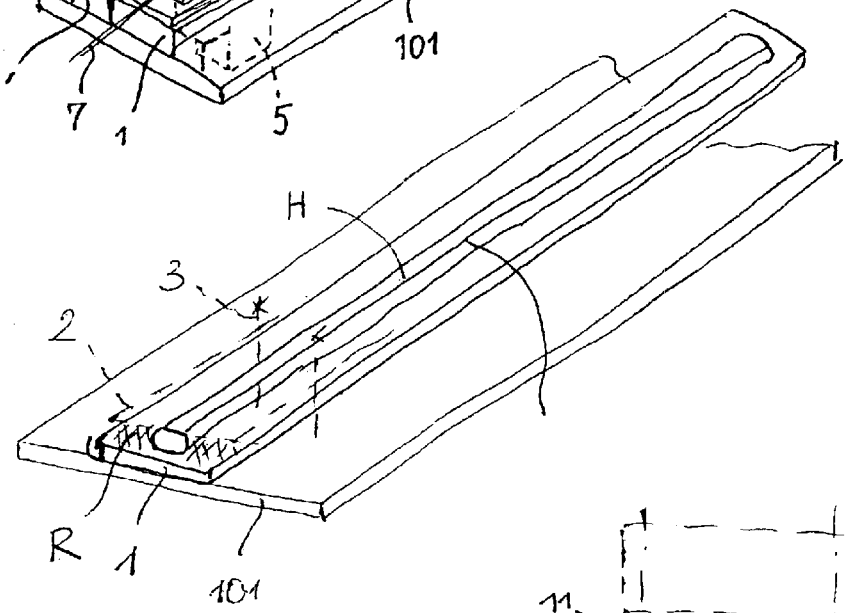
FIG8
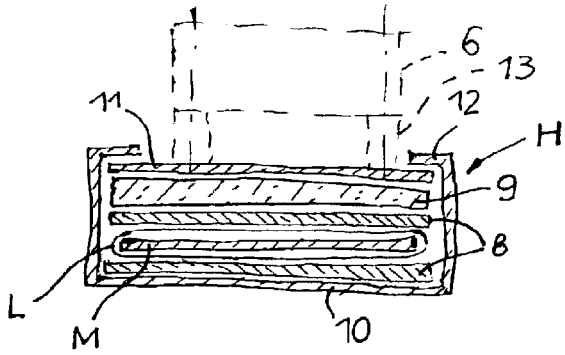
FIG 3

H
6
4
14
6a
11
12
13
7
6b

L
h
b

15'
4
15
16
Y
x
L
M 4
17
L
M
M
18

PAVER AND HEATING ELEMENT

FIELD OF THE INVENTION

The invention relates to a paver that includes a working component in the form of a smoothing plate that includes a heating element.

BACKGROUND OF THE INVENTION

In the case that a paver is processing hot paving material working components of the paver need to be heated until the paving material does not tend any more to glue. The temperature of the paving material is about 170° C. Heating normally starts prior to the beginning of a paving process. Heating continues during the paving process. The mentioned working components may be the smoothing plate of the paving screed, the tampering bars, the pressing bars or the container for the paving material. It is conventional in practice to mount at least one electric flat heating rod on the heating area of the smoothing plate. The flat heating rod is supplied with rotary current by a rotary current generator of the paver. At least one electric flat heating rod also is inserted into the tampering bar or into the pressing bar if a pressing bar is provided. The known flat heating rod consists e.g. of a drawn round tube which is pressed into a flat configuration such that flat upper and lower sides are formed. A heating coil made of a coil spring-like wound heating wire is inserted in serpentine line configuration into the flat tube and is secured and positioned by an insulating filling of ceramic powder. Such flat heating rods only can be manufactured with a width somewhat below 20 mm. Due to the design of the flat heating rod effective heat transfer takes place essentially only in the central region of the narrow contact area while in the edge regions of the contact area hardly a heating effect can be generated. An unfavourable heating picture results in the heating area of the working component. Furthermore, relatively long heating-up periods have to be encountered and irregular heating pictures. A further drawback is that the heating rods are formed with an integrated slim connection housing at one rod end which connection housing protrudes vertically from the heating rod and which easily can be damaged by aggressive medias as used in a paver. In case of a replacement of a flat heating rod the connection housing also has to be replaced together with the electric connection cable. Due to the relatively bad heat transfer of the flat heating rod a relatively high electric supply power is needed. Since conventionally, a plurality of such heating rods is implemented into a paver, the plurality of heating rods results in an undesirably high load of the rotary current generator.

The flat heating rod conventionally is secured by means of tensioning screws protruding from the smoothing plate via an intermediate metal profile onto the smoothing plate. The tensioning screws have to be provided at the side of the heating rod. A direct heating in the alley defined along the array of the tensioning screws in the heating area is impossible.

In a paver known from U.S. Pat. No. B1-6,318,928 several heating elements are mounted on the smoothing plate of the paving screed via a heat distributing plate. Each heating element is a rigid, hollow metal rod containing an interiorly placed resistive coil. The heating elements are heating rods which are conventional in this technique. The heating elements allow to heat a limited heating area only and with a relatively badly defined heating picture.

DE 46 03 33 C discloses an electric heating body containing an elastic insert made from asbestos. An insulated resistive wire is wound around the insert. The insulated heating coil is surrounded by a coat made of thin sheet metal. The coat is confined in a strong metallic sleeve. During manufacturing of the heating element the metallic sleeve temporarily is deformed under pressure such that after relief of the pressure the asbestos insert presses the heating coil against the sheet metal coat.

BRIEF DESCRIPTION OF THE INVENTION

It is an object of the invention to provide a paver as mentioned or a heating element, respectively, which allow to optimally heat the respective heating area already with only moderate supply power.

A plane heating element may be adapted in its width and length and by its circumferential contour even better to the heating area such that an effective heat transfer is achieved practically over the full width of the heating element. The heating effect of the heating element may be uniform over the longitudinal and width dimensions, or even may be variable. Variable means that in zones of the heating area where more heat is needed for a predetermined heating picture than in other zones at such locations, more heat is produced by the heating element per area unit than at other locations. This can be achieved either by the peripheral contour of the carrier material onto which the heating conductor is wound with continuous winding density and/or by varying the winding density of the heating conductor. The plane heating element, so to speak, is customised for the respective application case or for the respective heating area and the heating picture as desired in the heating area. In this case the carrier material essentially dictates the form and the size of the heating element while the heating conductor is adapted to the conditions on the carrier material. The heating element is excellently suitable for heating the smoothing plate of the paving screed of the paver. An optimum heating picture, that is, the pattern of amplitude of the heat distribution within the plate, at the smoothing plate already can be achieved by the heating element with moderate power supply only. The produced heat in some cases may be distributed by the intermediate member to an even larger width and/or length. The plane heating element as well is useful for tamper rods or pressing rods or for containers which are to be heated.

In order to temporarily or permanently raise the heating power depending on demand at least a second (or even further) heating conductor may be provided on the same carrier material. Each further heating conductor can be activated selectively. This may be expedient also for redundancy reasons, e.g. in case of a failure of another heating conductor.

The heating conductor should have a band-like cross-section such that the heating conductor can be wound comfortably and snugly around the carrier material. A band width between 1.5 mm and 4.0 mm, preferably of about 2.0 mm, and a band thickness between 0.1 mm and 0.4 mm, preferably of about 0.2 mm, has proven as being very expedient. The material of the heating conductor, e.g. may be tungsten or a tungsten alloy.

The heating conductor, expediently, ought to be wound around the carrier material such that the windings are distant from each other. The winding density may be constant over the longitudinal extension of the carrier material such that the heating element continuously generates an equal heating effect per area unit. For cases where the heating area contains zones of elevated heat demand in order to achieve a predetermined heating picture, e.g. because heat consuming assemblies or masses are provided close to the heating element, the winding density then may be variable, i.e. that the heating power per area unit is larger in zones of increased heat demand than in other areas of the heating element. In some cases at least one further, selectively activated heating conductor may be provided only in a zone having increased heat demand.

In order to increase the efficiency of heating the heating area, a damp course may be provided at the side of the carrier material onto which the heating conductor is wound opposite to the heating area. The damp course drives, so to speak, generated heat in the desired direction into the heating area. The damp course may be integrated into the heating element and/or even may be provided on an outer side of the heating element.

In view to the coarse operating conditions in a paver the carrier material onto which the heating conductor is wound should be enclosed between flat covering sheet metals, and should be sealed such that no aggressive medias are allows to intrude. The lower covering sheet metal may form a heat distributing intermediate member. Alternatively, a heat distributing intermediate member may be placed below the lower covering sheet metal.

In a structurally simple way the covering sheet metals are interconnected in sealed fashion in the edge region of the heating element. For example, the edge of one covering sheet metal being cut with larger dimensions is formed around the edge of the other covering sheet metal and in some cases is soldered or welded or may be sealed in another way. The material of the covering sheet metals may be steel or aluminium.

The plane heating element may have a total thickness of only about 4.0 mm to 10.0 mm, expediently of only about 5 mm to 6 mm. The carrier material only needs to have a uniform thickness between 1.0 mm and 3.0 mm.

A plane heating element having a longitudinal extension between 0.9 m and 2 m, preferably of about 1.1 m, and a width of about 50 mm to 100 mm, preferably of about 60 mm, is particularly suitable for a smoothing plate of conventional size. The heating element then would be designed for a power consumption of between 500 watts and 1,000 watts, preferably of only about 600 watts.

The carrier material is at least one rectangular strip. It is, however, possible to place several strips of the carrier material side by side and to wind a heating conductor around each strip such that both ends of the heating conductor can be let out at the same side of the heating element.

According to a further important aspect breakouts are provided in the heating element for fastening elements like the tensioning screws which serve to mount the heating element in conventional fashion on the smoothing plate. The breakouts even might lead through the heating element, because this allowed by the design of the plane heating element. This measure improves the hold of the heating element against forces caused in operation by thermal or vibrating influences. Furthermore, even the alley defined by the array of the tensioning screws directly can be heated in the heating area of the smoothing plate.

In terms of easy maintenance and high operational safety it is expedient to provide a connection box on top of the heating element, preferably on the side opposite to the heating area. The connection box may be mounted directly or via spacer elements on the covering sheet metal of the heating element. In some cases a clamp bar may be provided in the connection box for connecting the ends of the heating conductor and of a connection cable and to allow to loosen the connection in case of maintenance or of a replacement. The connection cable may be introduced into the connection box through a sideward breakout such that cleaning agents or other aggressive liquids do not collect in this region but flow downwards immediately. A conventional heat resistant screwed cable gland may be implemented as a connection cable introduction which screwed cable gland then is oriented horizontally in the operating position of the heating element on the working component. The breakouts for the ends of the heating conductor and/or the breakouts for the heating conductor ought to be sealed by potting material to prevent the intrusion of aggressive medias into the interior of the heating element.

BRIEF DESCRIPTION OF THE DRAWINGS

Embodiments of the invention will be explained with the help of the drawing. In the drawing is:

FIG. 2 a perspective view of a smoothing plate with a heating element mounted thereon, FIG. 3 a cross-section of the heating element, FIG. 4 a perspective view of the heating element, FIG. 5 a perspective view of a detail of the interior structure of the heating element, FIG. 6 a section of a heating conductor in a perspective illustration, FIG. 7 a top view of a part of a slightly varied embodiment, and FIG. 8 a perspective view of a further embodiment.

DETAILED DESCRIPTION OF THE INVENTION

Figure 1:
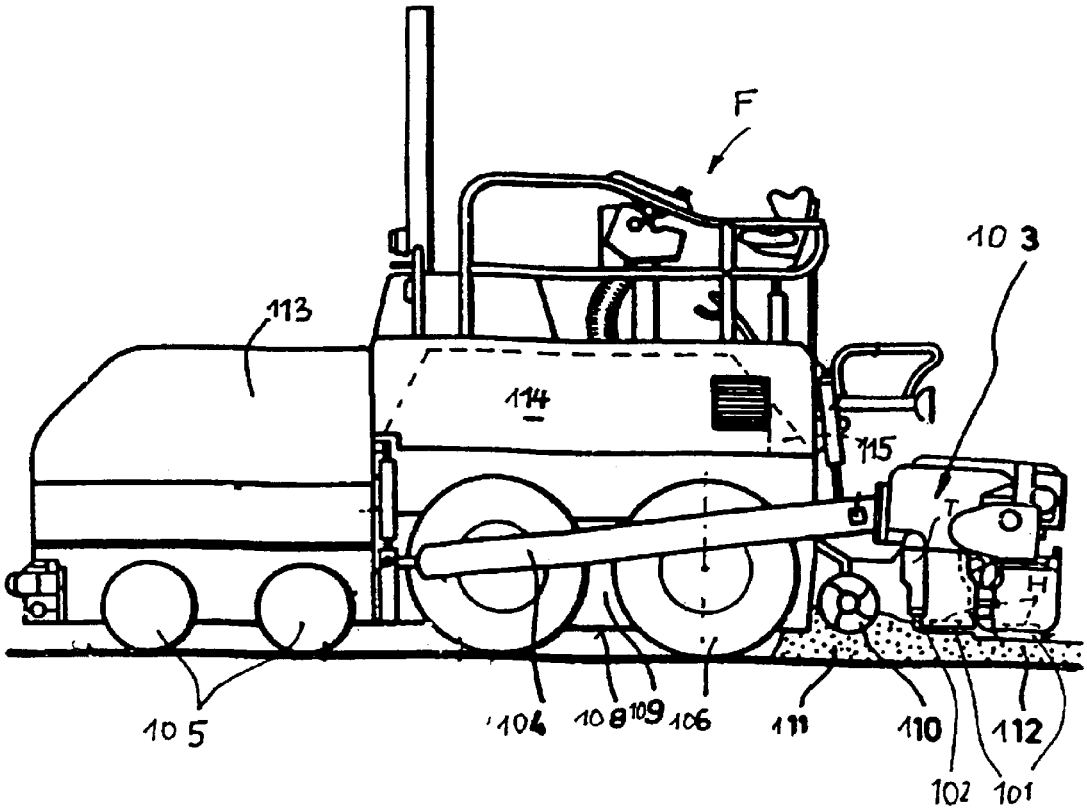
FIG. 1 a schematic side view of a paver.

A paver F in FIG. 1 has a chassis 108 and front wheels 105 and rear wheels 106. A paving material hopper 113 is arranged at the front end of the chassis. A diesel motor constituting a primary driving source 114 is located behind the hopper 113 and is connected to a rotary current generator 115. A long side conveying device 109 extends between the hopper 113 and the rear end of the chassis and serves to throw paving material 111 on the ground behind the paver. A lateral distribution device 110 is provided at the rear end of the chassis which uniformly spreads the paving material 111 to both sides. A paving screed 103 is dragged by side beams 104. The paving screed 103 rides on the paving material 111 and forms a covering layer 112. The paving screed 103 is equipped with lower smoothing plates 101 which are heated electrically by plane heating elements H. Furthermore, a tamper T is indicated working in the paving material 111 by means of an oscillatingly driven tamper rod 102. The tamper rod 102 also may be equipped with a not shown heating element. In case of special embodiments of a paving screed 103 even pressing or compacting rods (not shown) may be provided which also are heated by heating elements. Furthermore, it is possible to use such heating elements also in (not shown) containers of the paver S for heating purposes. The heating elements H e.g. are supplied with rotary current from the generator 115.

The smoothing plate 101 shown in FIG. 2 is a steel plate on which in this case a plane heating element is mounted by an array of tensioning screws 3. The tensioning screws 3 penetrate breakouts 4 of the heating element H. The heating element H is a generally rectangular strip e.g. of a length of about 1.1 m and a width of about 60 mm. A heat distributing intermediate member 1, e.g. a metal profile, may be provided below the heating element H. On top of the heating element H a metal profile 2 is placed which is shown in dotted lines. The whole structure is mounted with the help of the tensioning screws 3 on the smoothing plate 101. A connection box 6 is mounted on the heating element H. A connecting cable 7 horizontally is introduced into the connecting box 6. In dotted lines further components of the paving screed are shown at 5. Such components may, in some cases, contact the smoothing plate 101 and may call for an increased heating effect per area unit of the smoothing plate 101 at this location than that required in other areas. Another intermediate member 1' could be significantly broader and/or longer than the heating element H itself.

For clarity reasons the cross-sectional view of the plane heating element H is shown in FIG. 3 in an oversized scale. The total height of the heating element H is only between about 5 mm and 10 mm. At least one heating conductor L is wound in spirals around a plane carrier material M. The heating conductor L serves to generate heat. The carrier material M which e.g. has the consistency of a cardboard plate and the thickness of only about 1.0 mm, has a peripheral form which may be adapted to the desired heating area or the needed heat picture on the working component. Insulating layers 8 may be provided on top of and below the carrier material. Furthermore, it may be expedient to provide a heat damp course 9 on top of the heating element in order to drive the generated heat downwardly into the heating area. The above-mentioned layer structure is covered by a lower covering sheet metal 10 and an upper covering sheet metal 11. An edge 12 of the lower covering sheet metal 10 is bent around the edges of the upper covering sheet metal 11 and is secured in a sealed fashion. The connection box 6 is indicated in dotted lines. The connection box may be mounted with the help of spacing elements 13 directly on the upper covering sheet metal 11. Further heat damp courses (not shown) also may be provided in the side areas. The lower covering sheet metal 10 constitutes a heat distributing intermediate member such that the separate intermediate member 1 or 1' may be dispensed with.

Figure 4:
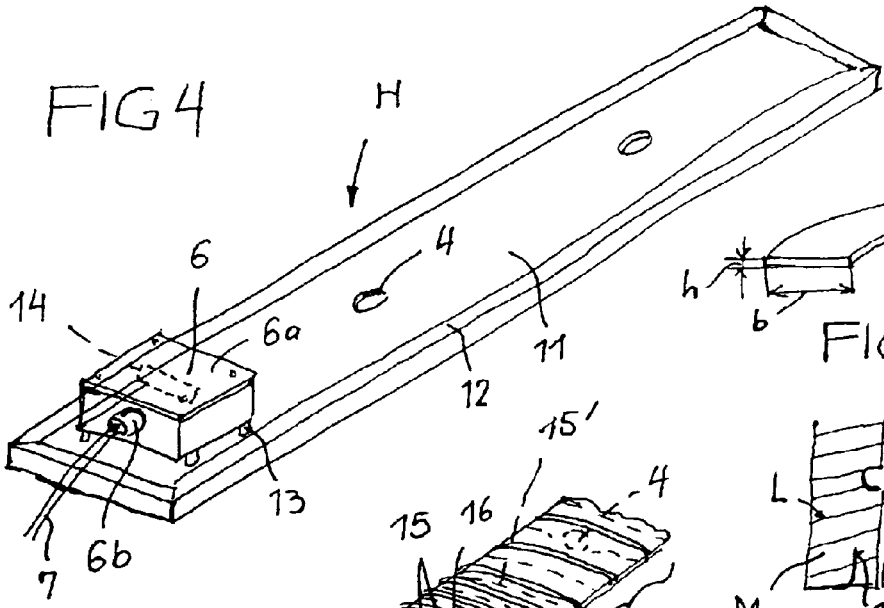

The perspective view of the plane heating element H in FIG. 4 shows how the breakouts 4 at the positions of the tensioning screws 3 of the smoothing plate penetrate the heating element H. Alternatively, the plane heating element H could be formed without any breakouts. The connection box 6 mounted by the spacing elements 13, expediently, has a removable cover lid 6*a* and a horizontally oriented introduction 6*b* for the connection cable 7. In the interior of the connection box 6 a clamp bar 14 may be provided (shown in dotted lines) at which the heating conductor ends and the connection cable 7, both introduced into the connection box 6, may be connected with each other. After removal of the cover lid 6*a* the connection cable 7 only needs to be released in case that the heating element H has to be replaced. The connection cable 7 may remain unchanged for the new heating element. In some cases the heating conductor L may be connected directly to the connection cable 7. In this case the connection box 6 serves to secure the ends of the heating conductor and the connection cable in place, e.g. in order to keep the heating conductor L free of any pulling forces.

Figure 5:
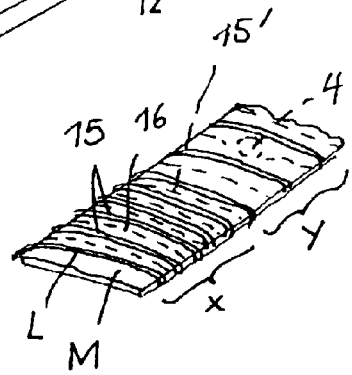

FIG. 5 illustrates how the heating conductor L forms windings 15 which e.g. extend laterally around the carrier material M. Intermediate distances 16 are provided between the windings 15. An area of higher winding density is indicated by x, while y indicates an area of lower winding density. The breakouts 4 e.g. may extend through the carrier material M and in-between the windings 15. In the area x the heating power per area unit is larger than in the area y. Alternatively, the heating conductor L could be wound around the carrier material M in longitudinal direction. Alternatively, at least one further, preferably selectively activated heating conductor L may be wound in windings 15' around the carrier material M. The further heating conductor allows to switch in a second heating power stage.

Figure 6:
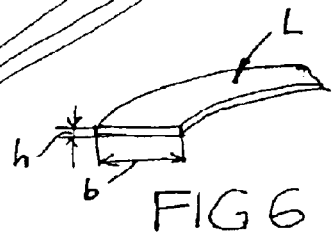

The heating conductor L in FIG. 6 expediently is a profiled heating wire having rectangular or oval band cross-section and a band width b between 1.0 mm and 5.0 mm and a band thickness h between 0.1 mm and 0.5 mm. The heating conductor L is laid by its flat sides onto the carrier material M and is bent perpendicular to the band thickness.

Figure 7:
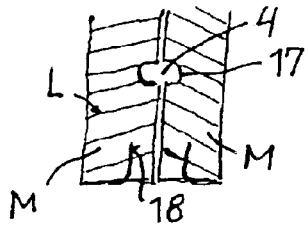

FIG. 7 indicates that the breakouts 4 alternatively could be defined between two juxtaposed strips of the carrier material M. Each strip or at least one strip has a cut-out 17 in edge for forming the edge of a breakout 4. The respective heating conductor L is wound even around the edge of the cut-out such that also the vicinity of the breakout 4 is heated. The ends of the heating conductor are indicated at 18.

Normally one strip (or two juxtaposed strips) of the carrier material M will be sufficient to produce a predetermined heating picture in the heating area with a uniform or a varying winding pattern of the heating conductor or with the help of more than one heating conductor. The heating power per area unit may be varied by the winding density or by the geometrical peripheral form of the carrier material M and/or by means of at least one further heating conductor. The carrier material M may be cut in a respective expedient form in order to cope with the requirements in the heating area already by its form. A narrower region of the carrier material and the then shorter windings of the heating conductor in this region result in a reduced heating effect compared to the heating effect of a broader region of the carrier material and longer windings. Since the heating conductor L is wound around the carrier material the heating conductor may adapt to each desired peripheral contour of the carrier material M.

A conventional heating rod (having a round or flatly squeezed cross-section) is mounted in FIG. 8 as the heating element H on the intermediate member 1 which fully abuts in the heating area on the smoothing plate 101 and which distributes the heat in width direction and/or in longitudinal direction into the heating area. The intermediate member 1 is a metal profile (made from steel or light metal) or is a hollow body filled with a heat transfer medium, e.g. like thermo-oil. By means of the upper metal profile 2 and the tensioning screws 3 the heating rod is pressed on the intermediate member 1, and the intermediate member 1 is pressed onto the smoothing plate 101.

What is claimed is:

1. Paver, including a paving screed having at least one working component in the form of a smoothing plate comprising:

a power supply;

at least one electric heating element secured in heat transferring condition in a heating area of said working component, wherein said at least one heating element is a planar heating element comprising;

a planar carrier;

a heating conductor wound in a spiral around said planar carrier and connected to said power supply, and wherein the peripheral contour of said carrier and/or the winding density or the course of the windings of said heating conductor varies along the length of said carrier to produce a predetermined non-uniform heating picture in the heating area of said working component.

2. Paver as in claim 1, wherein said heating conductor has a band-shaped cross-section with a band width between 1.0 mm and 4.0 mm and a band thickness between about 0.1 mm and 0.4 mm.

3. Paver as in claim 1, further comprising at least one further heating conductor wound around said carrier, said further heating conductor adapted to be connected to a power supply.

4. Paver as in claim 1, further comprising a damp course provided in the interior of a housing element at least at the side of said carrier onto which said heating conductor is wound and which is opposite to the heating area of said working component.

5. Paver as in claim 1, wherein said carrier around which said heating conductor is wound is enclosed between cover sheets.

6. Paver as in claim 5, further comprising:

spacing elements on one of said cover sheets;

a connection box fixed to the side of said planar heating element which is opposite to the heating area on said spacing elements and a sealed introduction for a connection cable provided in a side wall of said connection box which introduction is oriented substantially horizontal in the operating position of said heating element of said working component.

7. Paver as in claim 5 wherein said cover sheets are of metal and the lower cover sheet forms a heat distributing intermediate member or is abutting on a heat distributing intermediate member respectively, said cover sheets being sealed and connected with each other in the edge region of the heating element around the periphery of said cover sheets.

8. Paver as in claim 1, wherein said planar heating element has a total thickness of between about 4.0 mm and 10.0 mm, and said carrier, around which said heating conductor is wound, has a substantially uniform thickness in the range of between about 1.0 mm and 3.0 mm.

9. Paver as in claim 1, wherein said heating element has a length between about 0.9 m to 1.2 m and a width of between about 50 mm to 100 mm, and has a power consumption of between about 500 watts and 1,000 watts, preferably of about 600 watts.

10. Paver as in claim 1, wherein said heating element further comprises breakouts for accepting fastening elements of said working component, said breakouts penetrating said carrier between spaced apart windings of said heating conductor.

11. Paver as in claim 1 wherein said heating element further comprises two carrier material strips extending longitudinally and are juxtaposed, at least one of said strips having a cut-out in its edges as the boundary of a breakout, and said heating conductor being wound around the edge of the cut-out.

12. Paver as in claim 1, wherein said working compound is a metal smoothing plate that is to contact the paving laid by the paver.

13. Paver as in claim 1, wherein said heating conductor comprises a pair of wires that are spaced apart.

* * * * *

UNITED STATES PATENT AND TRADEMARK OFFICE

CERTIFICATE OF CORRECTION

PATENT NO. : 6,963,050 B2
DATED : November 8, 2005
INVENTOR(S) : Heindtel

It is certified that error appears in the above-identified patent and that said Letters Patent is hereby corrected as shown below:

Title page,
Item [73], Assignee, delete "Joseph Voegle AG, Mannheim (DE)" and substitute with -- Joseph Vogele AG, Mannheim (DE) --.

Signed and Sealed this

Seventh Day of March, 2006

JON W. DUDAS
*Director of the United States Patent and Trademark Office*